United States Patent [19]

Furuya

[11] Patent Number: 4,460,004

[45] Date of Patent: Jul. 17, 1984

[54] APPARATUS FOR DETECTING DIFFERENT KINDS OF COINS FOR USE IN A COIN HANDLING MACHINE

[75] Inventor: Katusuke Furuya, Tokyo, Japan

[73] Assignee: Laurel Bank Machine Co., Ltd.

[21] Appl. No.: 349,154

[22] Filed: Feb. 16, 1982

[30] Foreign Application Priority Data

Feb. 18, 1981 [JP] Japan ..... 56-21965[U]

[51] Int. Cl.[3] ..... G07D 9/00

[52] U.S. Cl. ..... 133/8 R; 133/1 A; 194/100 A

[58] Field of Search ..... 133/8 A, 1 A; 194/100 A

[56] References Cited

U.S. PATENT DOCUMENTS 4,108,296 8/1978 Hayashi et al. ..... 194/100 A
4,123,892 11/1978 Asami ..... 133/1 A
4,362,176 12/1982 Watanabe ..... 133/1 A

*Primary Examiner*—Joseph J. Rolla
*Assistant Examiner*—C. Compton
*Attorney, Agent, or Firm*—Fleit, Jacobson, Cohn & Price

[57] ABSTRACT

An apparatus for detecting different kinds of coins for use in a coin handling machine includes a coin selecting groove and a cam actuating the coin selecting groove to select the width of the coin selecting groove. Coin kind setting switches are provided for setting the particular kind of coins to be handled in accordance with the material thereof. The coin kind setting switches are actuated by coin kind selecting cams operatively associated with the cam to set detection levels. A detection coil device is provided adjacent to the coin selecting groove and detects the passing coin to issue a level signal in accordance with the material of the coin. A control circuit includes a comparator for comparing the detection levels set by the coin kind setting switches with the level signal detected by the detection coil device to detect an abnormal coin.

4 Claims, 4 Drawing Figures

APPARATUS FOR DETECTING DIFFERNT KINDS OF COINS FOR USE IN A COIN HANDLING MACHINE

BACKGROUND OF THE INVENTION

This invention relates to an apparatus for detecting different kinds of coins for use in a coin handling machine such as a coin counting machine, a coin wrapping machine and the like.

Conventional coin counting machines or coin wrapping machines count or wrap the coins previously classified according to their denominations or diameters. As for the diameters for coins which are now circulated in Japan, old 50 yen coins have a diameter of 25.0 mm; 10 yen coins have a 23.5 mm diameter; 100 yen coins, 22.6 mm; 5 yen coins 22.0 mm; new 50 yen coins; 21.0 mm; and 1 yen coins, 20.0 mm. Therefore, there is only a small difference in diameter between 100 yen coins and 5 yen coins, i.e. 0.6 mm, and also between new 50 yen coins and 1 yen coins, i.e. 1.0 mm. Accordingly, if 5 yen coins and 1 yen coins which are made of a relatively soft material are crushed at their edges, so that they become layer partially, the coins classified as 100 yen coins would include 5 yen coins because the detecting apparatus does not accurately detect the kinds of the coins and similarly the coins classifed as 50 yen coins would include 1 yen coins.

Accordingly, in conventional coin wrapping machines, for example, 5 yen coins would be mixed in with the wrapped 100 yen coins.

SUMMARY OF THE INVENTION

It is, therefore, an object of the invention to provide a reliable apparatus for detecting different kinds of coins for use in a coin handling machine.

In accordance with the present invention, there is provided an apparatus for detecting different kinds of coins for use in a coin handling machine which comprises a coin selecting groove, a cam associated with the coin selecting groove for selecting the width of the coin selecting groove in accordance with the kind of coins to be handled, a detection coil device positioned adjacent to the coin selecting groove for passing a magnetic flux across the coins selected and transferred into the coin selecting groove and picking up a variation in magnetic flux to generate a level signal, a coin kind selecting cam means actuated together with the cam, a coin kind setting switch means associated with the coin kind selecting cam means for setting detection levels corresponding to the material of the particular kind of coins to be handled, and a control circuit for detecting abnormal coins comparing the detection levels set by the coin kind setting switch means with the level signal detected by the detection coil device.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will be now described in detail with reference to the accompanying drawings.

Figure 1:
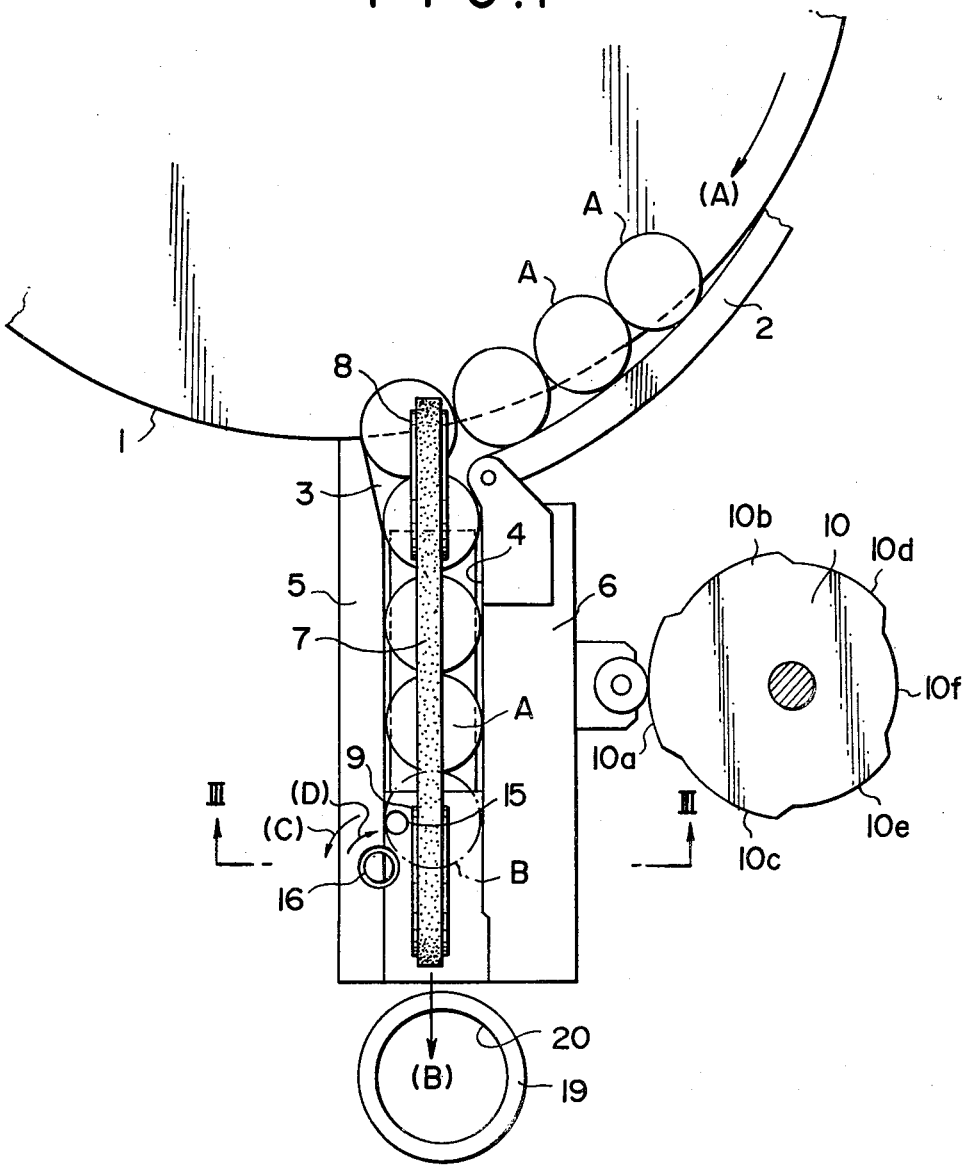
FIG. 1 is a plan view showing a main portion of a detecting apparatus according to the invention.

There is provided a rotary disc 1 which is driven to be rotated in a direction of an arrow (A) of FIG. 1 by a motive source such as a motor, not shown. The rotary disc 1 is provided at its periphery with a guide plate 2 for guiding the coins A which have been moved to the periphery of the rotary disc 1 by means of the centrifugal force of the rotary disc 1. The guide plate 2 is notched at a portion thereof to form a pocket section 3. At the pocket section 3, a coin selecting groove 4 is positioned so that the coins are introduced from the rotary disc 1 into the coin selecting groove 4. The coin selecting groove 4 is defined by a fixed selecting plate 5 which stops the movement of the coins in the direction of an arrow (A) and guides the coins in the direction of an arrow (B) and a movable selecting plate 6 which rotatably supports the guide plate 2 and is adapted to be moved relative to the fixed selecting plate 5 in the direction of the width of the coin selecting groove 4.

Positioned above the coin selecting groove 4 is a coin transfer belt 7 which engages with the coins introduced into the groove to move the same in a direction of the arrow (B). The coin transfer belt 7 is trained on pulleys 8 and 9, at least one of which is connected to a motive source, not shown.

The movable selecting plate 6 is engaged at one side thereof with a cam 10 which is rotatably supported. The movable selecting plate 6 is pushed to the fixed selecting plate 5 by means of cam surfaces 10*a* to 10*f* of the cam 10 to vary the width of the coin selecting groove 4 in accordance with the kinds of the coins.

An upwardly extending rotary shaft 11 is integrally formed with the cam 10. A plurality of coin kind selecting cams 13 (three cams in the embodiment) which is rotated in accordance with the coin kind to be counted or to be wrapped by a handle 12 or a motive source such as a motor, not shown, is secured to the rotary shaft 11. A plurality of coin kind setting switches 14 by which is set a detection level corresponding to the material of one coin of a particular kind among six kinds of coins is provided so as to have a switch corresponding to each cam 13. The coin kind setting switches 14 are connected to a control circuit which will be described hereinafter.

Adjacent to the coin transfer belt 7 is provided a detection coil device 15 which causes a magnetic flux to pass cross the coins A transferred by the coin transfer belt 7 and detect a variation in magnetic flux. The detection coil device is connected to the above-mentioned control circuit to be described hereinafter and is adapted to discriminate the kinds of coins.

Figure 2:
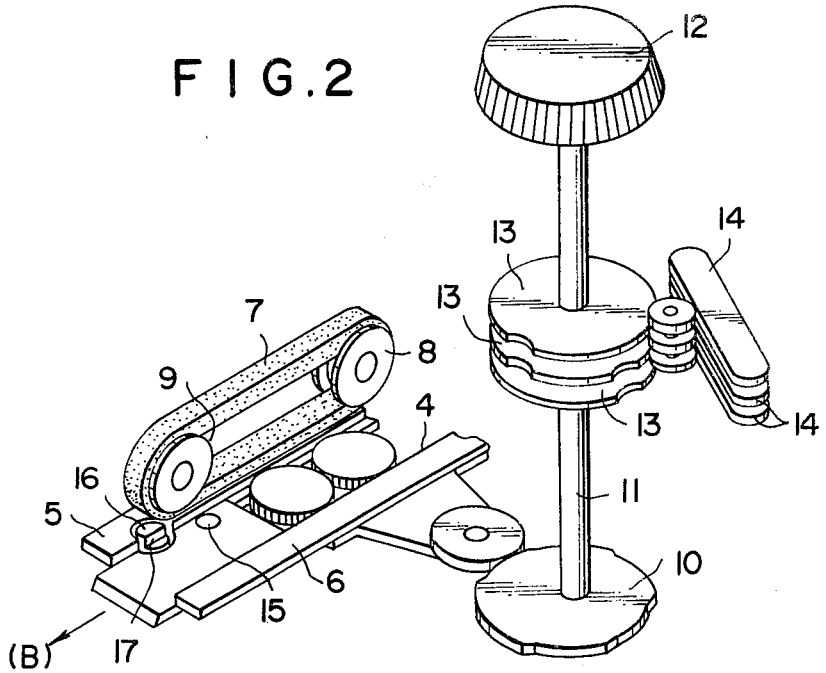
FIG. 2 is a perspective view of FIG. 1.
Figure 2:
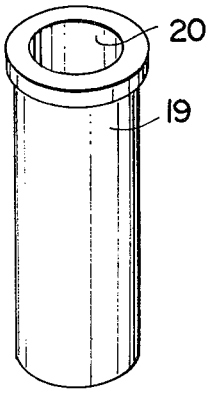
Figure 3:
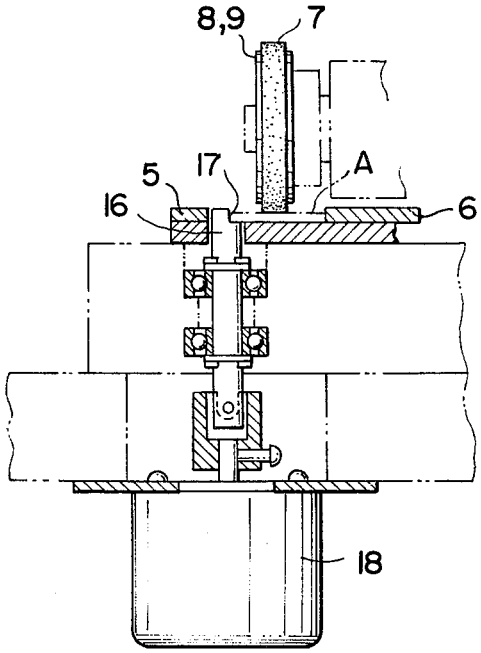
FIG. 3 is a cross-sectional view taken along the lines III—III of FIG. 1.

In addition, the fixed selecting plate 5 is provided with a stop 16 which prevents the coin from passing through by projecting into the coin selecting groove 4 when the coin is judged to be abnormal. The stop may be of a rod shape, as shown in FIGS. 1 to 3 and is rotatably mounted. The stop extends through the fixed selecting plate 5 and is formed at its upper end with a cut-out 17. The vertical surface and horizontal surface of the cut-out 17 are adapted to be in alignment with, respectively, the inner surface of the fixed selecting plate and the upper surface of a bottom plate provided between the fixed and movable selecting plates 5 and 6 within the groove 4 when the coins pass by the stop. The stop 16 is connected to a rotary solenoid 18 and the cut-out 17 of the stop 16 is rotated in the direction of an arrow (C) or (D) by operation of the rotary solenoid 18 to cause the coin A to pass or to stop.

Furthermore, in the embodiment, the fixed selecting plate 5, the movable selecting plate 6, the coin transfer belt 7, the detection coil device 15, and the hereinafter described control form a coin counting section.

A coin accumulating cylinder 19 is provided downstream of the coin selecting groove 4 and the coins A which have been selected and counted drop into the inside 20 of the coin accumulating cylinder 19. The coins which are accumulated to a predetermined number, for example, 50 pieces, are then transferred to a coin wrapping section in which the coins are wrapped.

Figure 4:
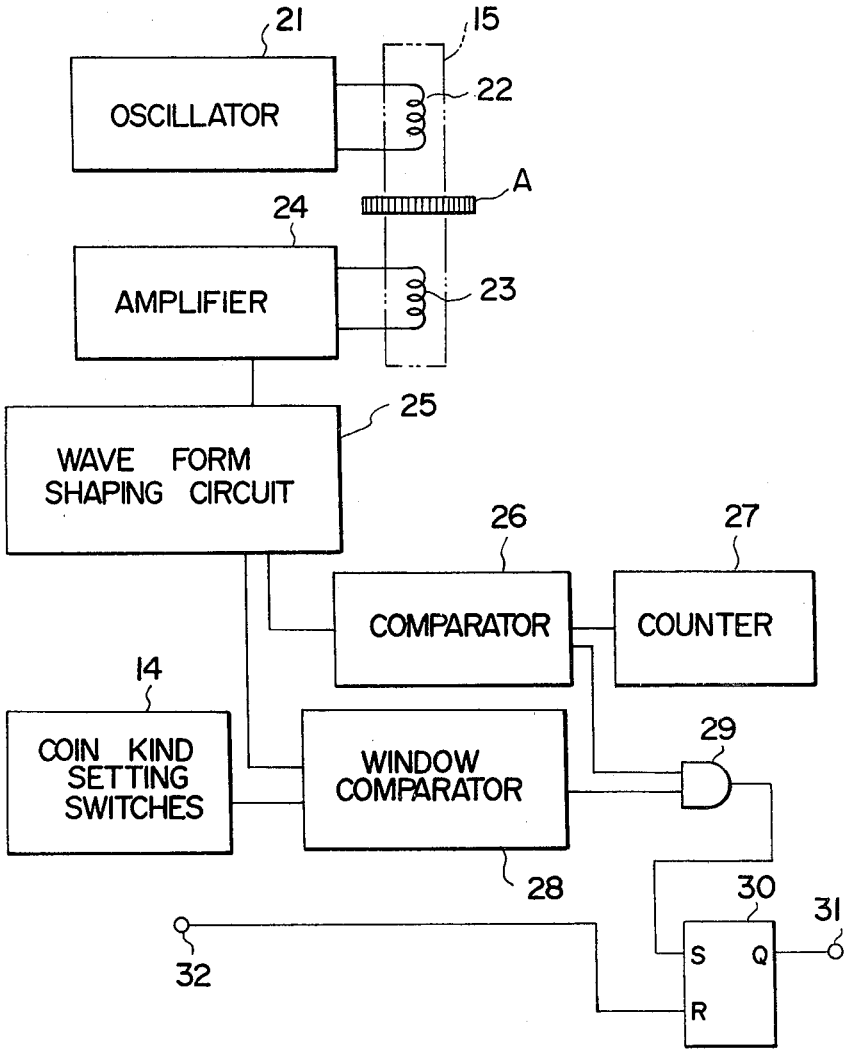
FIG. 4 is a block diagram showing a central circuit used in the detecting apparatus.

Referring now to FIG. 4, there is shown one embodiment of the control circuit. An oscillator 21 is connected to an oscillating coil 22. The magnetic flux which is generated by the oscillating coil 22 crosses the coin A and induces an eddy current in the coin A. A pick-up coil 23 is positioned at the opposite side of the passing coin relative to the oscillating coil 22 to pick up the magnetic flux which is generated by the oscillating coil 22 and is varied by the eddy current induced in the coin A. The pick-up coil 23 is connected to a wave form shaping circuit 25 through an amplifier 24. One output terminal of the wave form shaping circuit 25 is connected to a comparator 26. An "H" level signal is issued from the output terminal of the wave form shaping circuit 25 when the coin A passes by the detection coil device 15. One input terminal of the comparator 26 is connected to a counter 27 which counts the number of the coins A which have passed. The above-mentioned coin kind setting switches 14 are connected to a window comparator 28. The window comparator 28 is composed of two differential amplifiers, one of which sets an upper limit comparison level and the other of which sets a lower limit comparison level, and detects a voltage value between two set levels. The other output terminal of the wave shaping circuit 25 is connected to the input terminal of the window comparator 28. The output signal of the wave form shaping circuit 25 and two signals set by the coin kind setting switches 14 are compared. When the output signal of the wave form shaping circuit 25 is out of the region between two set signals of the coin kind setting switches 14, an "H" level signal is issued from the window comparator 28. The output terminals of the comparator 26 and the window comparator 28 are connected to a flip-flop circuit 30 through an AND gate 29. When an abnormal coin is detected, a signal is issued from an alarm terminal 31 of the flip-flop circuit 30. The signal thus obtained is used for processing which will be described hereinafter.

Moreover, reference numeral 32 indicates a reset signal input terminal of the flip-flop circuit 30 which is used to reset the flip-flop circuit 30.

The operation of the embodiment according to the invention will be explained with reference to a coin wrapping machine. For the operation of the coin wrapping machine, the previously selected kind of coins, for example, 100 yen coins, are readied. The 100 yen coins thus prepared are put on the rotary disc 1.

According to the kind of coins to be wrapped (100 yen coins in the example), the coin kind selecting cam 13 is caused to be rotated by the handle 12 or the motive source such as a motor to actuate the coin kind setting switches 14. Then, the coin kind setting switches 14 set detection levels corresponding to the material of the 100 yen coins. At the same time, the rotation of the coin kind selecting cam 13 causes the cam 10 to rotate. Then, the movable selecting plate 6 is moved by the cam 10 and the width of the groove 4 is selected by the engagement of the cam surface 10*d*, which in the example corresponds to 100 yen coin, with the moveable selecting plate 6. It is preferable that the movable selecting plate 6 is urged by a spring toward the coin kind setting cam 10. The stop 16 is positioned so that it does not project into the groove. The flip-flop circuit 30 in FIG. 4 is made to be reset.

Then, when the rotary disc 1 is rotated in the direction of the arrow (A) of FIG. 1, the coins engaged with the guide plate 2 are transferred, one by one, into the pocket section 3. Then, only coins A which can closely fit in the coin selecting groove 4 are transferred, one at a time, in the direction of the arrow (B) by the coin transfer belt 7. When the coin A passes through the detection coil device 15, the magnetic flux generated by the oscillating coil 22 crosses the coin A and thus the signal picked up by a pick-up coil 23 is varied in accordance with the conductivity, the thickness, etc. of the coin A. In such a case, if the value variation corresponds to the variation in value a 100 yen coin would give rise to, an "H" level signal is not issued from the window comparator 28 of the FIG. 4, and therefore no signal is issued from the alarm terminal 31 of the flip-flop circuit of FIG. 4. Meanwhile, the signal caused to be put out by the comparator 26 due to the passage of the coin causes the counter 27 to count one, that is, to count the passage of the coin A.

On the other hand, assuming that an abnormal coin B, for example, a 5 yen coin which is crushed at its edge and therefore is larger and similar to the normal coin A in size but different in material is mixed in with the coins A. In such a case, when the abnormal coin B reaches the position where the magnetic flux of the oscillating coil 22 crosses the coin B, the magnetic flux of the pick-up coil 23 will be varied in accordance with the material, etc. of the abnormal coin B (5 yen coin). Consequently, the window comparator 28 which compares the coin kind set by the coin kind setting switches 14 with the coin kind corresponding to the output signal from the wave form shaping circuit 25 will issue an abnormal signal, that is an "H" level signal. Since, at the time, an "H" level signal is issued from the comparator 26 regardless of the coin kind, an "H" level signal is issued to put out an alarm signal from the alarm terminal 31.

The alarm signal is used to actuate the rotary solenoid 18 shown in FIG. 3 so that the stop 16 is instantaneously rotated to project into the coin selecting groove 4. Consequently, the stop 16 stops the subsequent coins A or the abnormal coin B plus subsequent coins A. At a result, although the coin transfer belt 7 moves to continue the transfer of the coins in the direction of the arrow (B), the coins A are not transferred in the direction of the arrow (B) due to slippage between the coin transfer belt 7 and the coins A. Furthermore, the alarm signal is also used to stop the rotations of the rotary disc 1 and the pulleys 8 and 9. Then, the abnormal coin B which remains at the detection coil device 15 or in the accumulating cylinder 19 is removed from of the coin wrapping machine.

Although, in the illustrated embodiment, the detection coil device 15 is provided adjacent to the stop, it may be provided in any position within the length of the coin selecting groove 4. Moreover, the detection coil device 15 is not limited to a combination of the oscillating coil 22 and the pick-up coil 23 and may be of any suitable type which can detect the materials of the coins. Moreover, the stop is not limited as to its configuration and direction of projection, etc., as long as it projects into the coin selecting groove 4 to stop the coins.

What is claimed is:

1. An apparatus for detecting different kinds of coins, said apparatus for use in a coin handling machine, said apparatus comprises:

a coin selecting groove with a fixed selecting plate and a movable selecting plate, a first cam controlling said movable selecting plate for selecting the width of the coin selecting groove in accordance with the size of coins to be handled, a detection coil positioned between said fixed selecting plate and said movable selecting plate passing a magnetic flux across the coins selected and transferred into the coin selecting groove and picking up a variation in magnetic flux and generating a level signal, a plurality of coin kind selecting cams actuated simaltaneously with said first cam, a coin kind setting switch controlled by the coin kind selecting cams for setting detection levels corresponding to the material of the particular kind of coins to be handled, a control circuit comparing the detection levels set by the coin kind setting switch with the level signal detected by the detection coil, and a stop positioned adjacent to said coin selecting groove actuated to stop the transfer of coins into said selecting groove upon indication by said control circuit of a level signal other than said level signal set by said coin kind setting switch.

2. An apparatus according to claim 1 wherein the detection coil device comprises an oscillating coil for generating a magnetic flux and passing the same across the passing coins and a pick-up coil for picking up magnetic flux variations through the passing coins.

3. An apparatus according to claim 1 wherein the control circuit comprises a window comparator for comparing the detection levels set by the coin kind setting switch means with the level signal detected by the detection coil device.

4. An apparatus according to claim 3 wherein the control circuit comprises a counter for counting up the number of passing coins through the detection coil device.

* * * * *